US009620889B1

(12) United States Patent
Buck et al.

(10) Patent No.: US 9,620,889 B1
(45) Date of Patent: Apr. 11, 2017

(54) POWER CONNECTORS FOR LINEAR LIGHTING

(71) Applicant: Elemental LED, Inc., Emeryville, CA (US)

(72) Inventors: Wesley Buck, Alameda, CA (US); James Stillman, Shenzhen (CN); Russell Petersen, Alameda, CA (US); Steven Gensler, San Jose, CA (US)

(73) Assignee: Elemental LED, Inc., Emeryville, CA (US)

( * ) Notice: Subject to any disclaimer, the term of this patent is extended or adjusted under 35 U.S.C. 154(b) by 0 days.

(21) Appl. No.: 15/373,598

(22) Filed: Dec. 9, 2016

Related U.S. Application Data

(63) Continuation-in-part of application No. 15/349,270, filed on Nov. 11, 2016, which is a continuation of (Continued)

(51) Int. Cl.

| | |
|---|---|
| ***H01R 31/06*** | (2006.01) |
| ***H01R 13/52*** | (2006.01) |
| ***H01R 4/02*** | (2006.01) |
| ***H01R 4/18*** | (2006.01) |
| ***H01R 4/12*** | (2006.01) |
| ***H01R 13/504*** | (2006.01) |
| ***H01R 13/508*** | (2006.01) |
| ***H01R 13/512*** | (2006.01) |
| ***H01R 13/58*** | (2006.01) |
| ***F21V 23/06*** | (2006.01) |
| ***F21V 19/00*** | (2006.01) |
| ***F21V 23/00*** | (2015.01) |
| ***F21V 31/00*** | (2006.01) |

(Continued)

(52) U.S. Cl.
CPC ..... *H01R 13/5208* (2013.01); *F21S 4/22* (2016.01); *F21V 19/003* (2013.01); *F21V 23/001* (2013.01); *F21V 23/06* (2013.01); *F21V 31/005* (2013.01); *H01R 4/023* (2013.01); *H01R 4/029* (2013.01); *H01R 4/12* (2013.01); *H01R 4/18* (2013.01); *H01R 13/504* (2013.01); *H01R 13/508* (2013.01); *H01R 13/512* (2013.01); *H01R 13/5205* (2013.01); *H01R 13/5845* (2013.01); *F21Y 2103/10* (2016.08); *F21Y 2115/10* (2016.08)

(58) Field of Classification Search
CPC ..... F21V 19/003; H01R 13/5208
See application file for complete search history.

(56) References Cited

U.S. PATENT DOCUMENTS

| | | | |
|---|---|---|---|
| 3,670,290 | A | 6/1972 | Angele et al. |
| 4,738,263 | A | 4/1988 | Seebach et al. |

(Continued)

*Primary Examiner* — Briggitte R Hammond
(74) *Attorney, Agent, or Firm* — PatentBest; Andrew McAleavey

(57) ABSTRACT

Connectors for connecting light emitting diode (LED) strip light to power are disclosed. The connectors include a housing with a first opening sized to accept an LED strip light and a second opening for a power cord or electrical leads. The openings open into an interior cavity with an internal vertical barrier to separate power and ground leads. Gripping structures proximate to the first opening retain the strip light. A gasket or gaskets within the connector seal the connector from the elements. The second opening may carry a strain relief molded to the power cord. Additionally, an adapter or nipple may be provided to connect the connector to conduit.

20 Claims, 9 Drawing Sheets

Related U.S. Application Data application No. 15/202,968, filed on Jul. 6, 2016, now Pat. No. 9,509,110.

(60) Provisional application No. 62/316,376, filed on Mar. 31, 2016.

(51) Int. Cl.

| | |
|---|---|
| ***F21S 4/22*** | (2016.01) |
| *F21Y 115/10* | (2016.01) |
| *F21Y 103/10* | (2016.01) |

(56) References Cited

U.S. PATENT DOCUMENTS

| | | | |
|---|---|---|---|
| 4,768,969 | A | 9/1988 | Bauer et al. |
| 4,952,177 | A | 8/1990 | Drake et al. |
| 6,000,951 | A | 12/1999 | Hansen et al. |
| 6,283,612 | B1 | 9/2001 | Hunter |
| 7,175,303 | B2 | 2/2007 | Kovacik et al. |
| 7,473,006 | B1 | 1/2009 | Bollman |
| 8,231,261 | B2 | 7/2012 | Gherardini et al. |
| 8,714,772 | B1 | 5/2014 | Levante et al. |
| 8,979,296 | B2 | 3/2015 | Wiemer et al. |
| 9,004,716 | B2 | 4/2015 | Ai |
| 9,206,964 | B2 | 12/2015 | Marsh et al. |
| 9,374,856 | B2 | 6/2016 | Winton |
| 2002/0106931 | A1 | 8/2002 | Hsien-Te |
| 2010/0008090 | A1 | 1/2010 | Li et al. |
| 2012/0002417 | A1 | 1/2012 | Li |
| 2013/0249394 | A1 | 9/2013 | Fay |
| 2015/0077998 | A1 | 3/2015 | Zhang |
| 2015/0241035 | A1 | 8/2015 | Dankelmann et al. |
| 2015/0285472 | A1 | 10/2015 | Evitt |

POWER CONNECTORS FOR LINEAR LIGHTING

CROSS-REFERENCE TO RELATED APPLICATIONS

This application is a continuation-in-part of U.S. application Ser. No. 15/349,270, filed Nov. 11, 2016, which is a continuation of U.S. application Ser. No. 15/202,968, filed Jul. 6, 2016, now U.S. Pat. No. 9,509,110, which claims priority from U.S. Provisional Patent Application No. 62/316,376, filed Mar. 31, 2016. All of those applications are incorporated by reference in their entirety.

BACKGROUND OF THE INVENTION

1. Field of the Invention

In general, the invention relates to power connectors for light-emitting diode (LED)-based lighting systems, and more particularly to power connectors for LED strip lights.

2. Description of Related Art

Flexible light-emitting diode (LED) strip lights are well known in the lighting industry, are versatile, and are commonly used in a variety of settings. Low voltage strip lights, typically operating on 12-24 volts of direct current (DC), are suitable for many situations, as they are easy to set-up, cost efficient, and adaptable to a number of different types of applications. Moreover, properly protected from the elements, they may be installed and operated safely outdoors and in wet environments. However, low voltage strip lights are prone to a significant voltage drop over longer distances, making them unsuitable for applications where longer lengths of strip lighting are needed.

For situations requiring longer runs of strip lighting, high-voltage strip lights are preferred, as voltage drop is less of an issue with higher voltages, allowing runs of up to 150 feet (50 meters) or more. High-voltage strip lights typically operate at standard household or commercial voltages, e.g. 120-240V, so often, no transformer is required. However, a rectifier may be used to convert from alternating current (AC) power to DC.

While high-voltage strip lights allow for longer runs and make voltage drop somewhat less of a problem, they come with risks of their own—electric shock, electrocution, and fire among them. Thus, electrical standards, formulated in order to mitigate such risks, often require that power cords or conductors from high-voltage elements be double jacketed or fully enclosed in electrical conduit. While high-voltage strip lights are potentially just as adaptable as their low-voltage brethren, components that allow high-voltage strip lights to be used in different environments while complying with prevailing electrical standards and providing a robust connection are few. Better structures and methods for connecting strip light, and particularly high-voltage strip light, to power would be useful.

SUMMARY OF THE INVENTION

One aspect of the invention relates to a connector for connecting a strip light to power. The connector has a housing that defines first and second openings, which open into an interior cavity. The first opening is sized and adapted to accept a strip light and may, for example, be generally rectangular. A vertical barrier within the interior cavity divides at least a portion of the interior cavity to separate power and ground leads. The vertical barrier includes a longitudinal portion that extends generally parallel to a long axis of the interior cavity and a transverse portion that is contiguous with, and extends transversely with respect to, the longitudinal portion. The vertical barrier is spaced and separate from sidewalls of the interior cavity and arranged such that the transverse portion faces the first opening and extends parallel to it.

The connector will typically also include sealing structure that seals at least an area around the vertical barrier, and usually, at least the perimeter of the first opening. For example, the connector may be divided into upper and lower portions, and a gasket may be seated in each portion. These first and second gaskets may traverse and seal an area around the vertical barrier as well as the perimeter of the first opening, and optionally, the second opening as well. Typically, the first and second gaskets would abut one another to make a seal.

In one embodiment, the second opening may be engaged with and carry a molded strain relief, from which a power cord emerges. In another embodiment, male or female connecting structure, such as a nipple or an opening sized to accept a pipe, may be provided around the second opening.

Another aspect of the invention relates to electrical connection assemblies for LED strip lights. These assemblies include a connector as described above with external male or female connecting structure, a length of conduit connected to the connector, and a junction box connected to the conduit. Typically, these components would be made of waterproof or weatherproof materials (such as plastic or metal) that meet local regulatory requirements for encapsulating electrical connections, particularly high-voltage connections. The conduit may have any number of standard fittings (e.g., elbows, etc.), and the second opening of the connector would generally have a standard size and be adapted to make a connection by typical means.

Other aspects, features, and advantages of the invention will be set forth in the following description.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
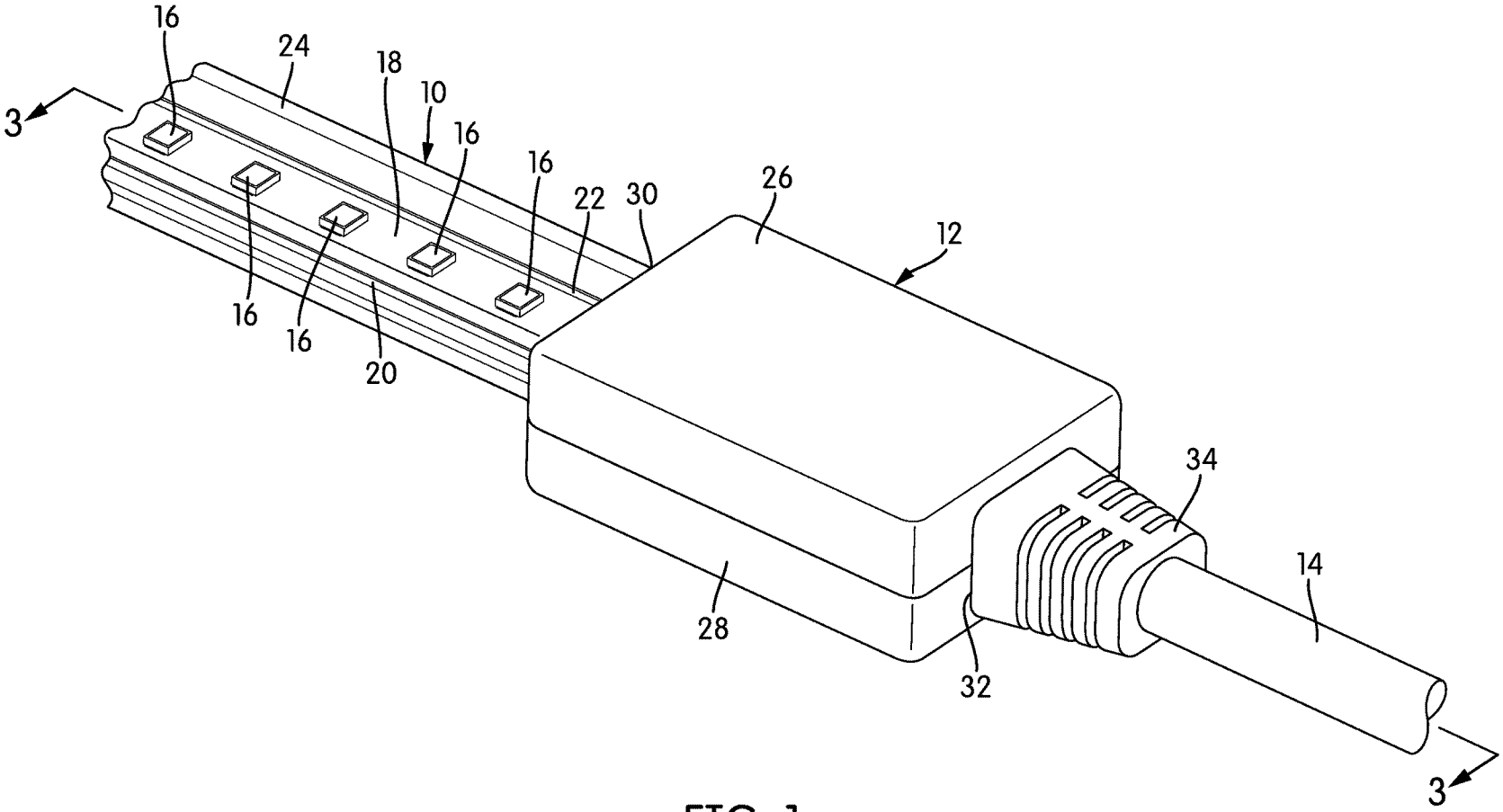
FIG. 1 is a perspective view of a strip of linear LED lighting connected to power via a connector according to one embodiment of the invention.

FIG. 1 is a perspective view of a strip of linear LED lighting, generally indicated at 10, connected to power via a power connector, generally indicated at 12. In this embodiment, the power connector 12 receives electrical leads from the linear LED lighting 10 and connects those leads to appropriate leads within a power cable 14 with a standard plug or other interface (not shown in FIG. 1).

The strip of linear LED lighting 10, which may also be referred to as strip light in this disclosure, may be of a variety of types. In general, the strip light 10 is of the type that includes a plurality of LED light engines 16 spaced at a regular pitch along a flexible printed circuit board (PCB) 18. The light engines 16 may be either bare LEDs or LEDs packaged with some combination of light-directing or light-diffusing optical elements (lenses, baffles, a phosphor or phosphors, a light diffuser, etc.). The light engines 16 may be single color, RGB selectable color, selectable or adjustable correlated color temperature (CCT), or have any other known features. The flexible PCB 18 may, for example, be made of Mylar or another suitable flexible material, and may have any number of layers, as necessary to convey power and signal along the length of the PCB 18.

The strip light 10 may also be either low voltage or high voltage. The terms "low voltage" and "high voltage" vary in meaning depending on which industry source is consulted. For purposes of this description, the term "high voltage" will be used to refer to any voltage greater than about 50V. Alternatively, "high voltage" might also be defined as any voltage for which building or electrical codes would require complete encapsulation or enclosure of the power conductors. While the connector 12 and associated structures may be used for either low voltage or high-voltage components, they are particularly useful for high-voltage components, as their use is intended to comply with electrical codes and standards for high-voltage components. In many embodiments, the strip light 10 will be operating at a rectified, direct current voltage equal to common household or commercial voltage—in the United States, about 120V.

The strip light 16 may be, for example, an INFINILINE® 120V AC strip light (Elemental LED, Inc., Emeryville, Calif., United States). Strip light of this type is described in more detail, for example, in U.S. patent application Ser. No. 15/202,199, filed Jul. 5, 2016, the contents of which are incorporated by reference herein. Briefly, the strip light 10 has two wire conductors 20, 22 that run the length of the PCB 18 to provide power and ground, and the entire assembly is covered in a translucent or transparent nonconductive, flexible coating, e.g., a poly(vinyl chloride) (PVC) coating 24. Overall, the strip light 10 has a rectangular cross-section. Of course, the particular details of the construction of the strip light 10 and its function are not critical to the invention.

The connector 12 has upper and lower halves 26, 28 that are secured together with fasteners (e.g., screws, clips, or molded, snap-fit elements). In other embodiments, the two halves 26, 28 (or other portions) may interengage without fasteners, e.g., with adhesives, by press-fit or interference fit, by heat-fusing, or by any other conventional means. Together, the two halves 26, 28 give the connector 12 a generally rectilinear shape with a first opening 30 sized and shaped to accept the strip light 10 and a second opening 32 through which leads from the power cord 14 exit. As used here, the terms "upper" and "lower" are labels, used with respect to the coordinate system of the drawings, to distinguish one part of the connector 12 from the other. As will be described below, these two parts 26, 28 may or may not be mirror images of one another, but if they are not mirror images of one another, the "sense" of which part 26, 28 carries which element may be reversed.

The first opening 30 is generally rectangular in the illustrated embodiment, and is sized to accept the strip light 10. That is, it is just larger than the strip light 10 and has at least generally the same shape as the strip light 10. As will be described below in more detail, the first opening 30 is particularly adapted to grip and make a seal against the strip light 10.

As shown in FIG. 1, the connector 12 carries a molded strain relief 34 that is engaged with the second opening 32 and abuts the exterior of the second opening 32. The power cord 14 is molded with and emerges from the strain relief 34. Although the external shape of the connector 12 is not critical, it is helpful in most installations if the connector 12 is as small as possible. Moreover, the two portions 26, 28 of the connector 12 need not be halves; any portions that can be conveniently divided for purposes of manufacturing and assembly may be used. The connector 12 and its halves 26, 28 are typically made of a reasonably rigid material, such as a plastic, although in some cases, the connector may be made of metal, particularly if certain interior elements are electrically passivated or insulated.

Figure 2:
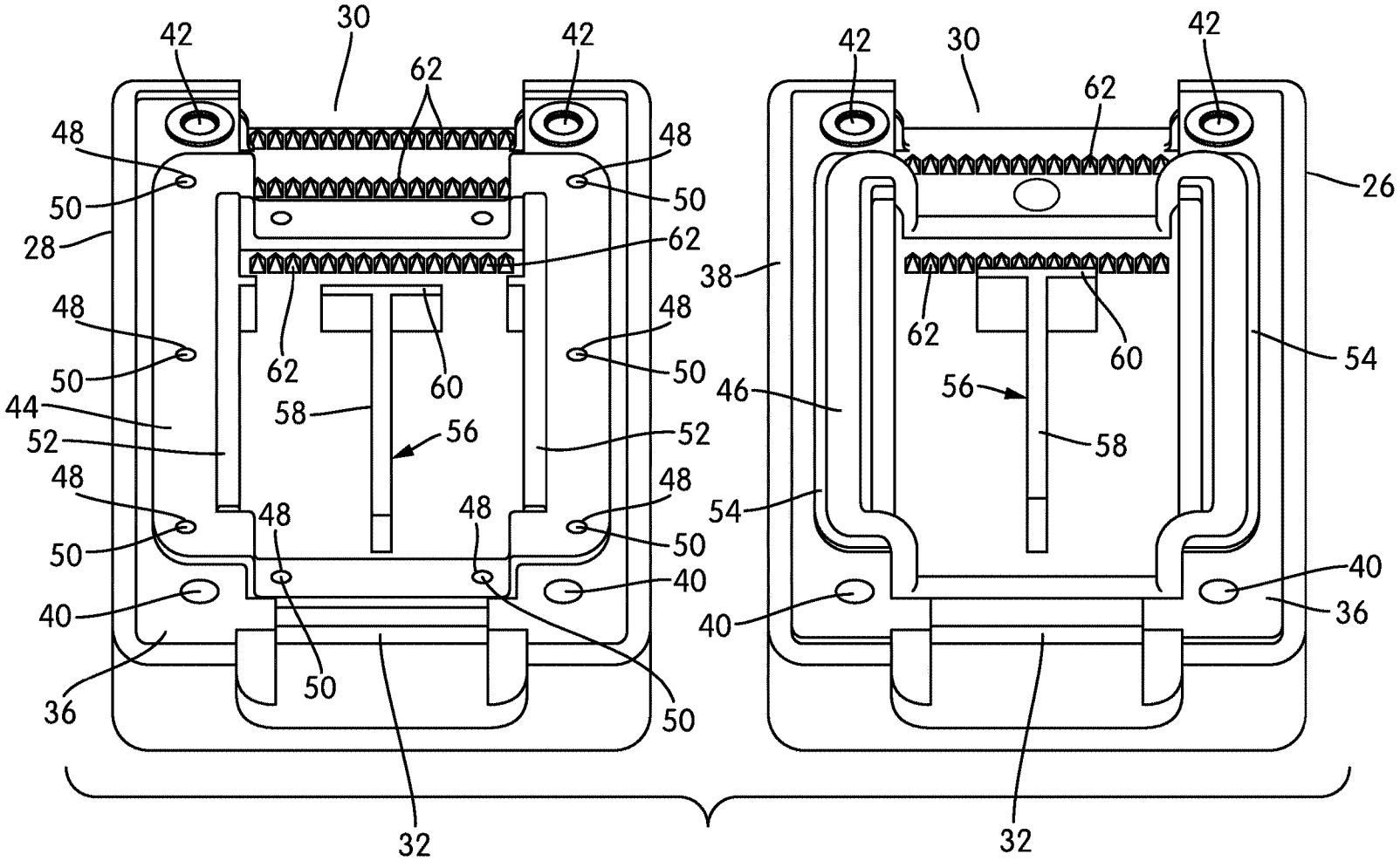
FIG. 2 is a perspective view of the respective halves of the connector of FIG. 1, illustrating their internal structure.

FIG. 2 is a perspective view of the two halves 26, 28 separated, illustrating the interior of the connector 12. The open areas that define the first and second openings 30, 32 are indicated in FIG. 2. As can be appreciated from FIG. 2, in the illustrated embodiment, the two halves 26, 28 are not mirror images of one another, although in other embodiments, they may be. However, although the two halves 26, 28 are not mirror images of one another, they are highly complementary in their features, such that together, they define the overall features of the connector 12.

Each half 26, 28 has an inwardly-extending lip 36 set just below its mating peripheral edge 38. The lip 36 extends around most of the perimeter of each half 26, 28 of the connector 12, breaking for the first and second openings 30, 32. Openings 40, 42 in the four corners of the lip 36 open into channels that are intended for fasteners to secure the two halves 26, 28 together. In other embodiments, the openings 40, 42 could be replaced with other types of cooperating, complementary fastening structures. As was noted above, the method of connecting the two halves 26, 28 is not critical. In some embodiments, machine screws may be used and the openings 40, 42 may have corresponding threads. In other embodiments, press-fit connectors may be used. In yet other embodiments, the two halves may be secured together by adhesives, soldering, welding, or any other suitable means of connection—although it is helpful if the connector 12 can be easily assembled and disassembled, for example, to replace the strip light 10.

A gasket 44, 46 rests on each lip 36. The gaskets 44, 46 are typically made of a rubber, or another resilient, nonconductive, water-resistant material. The gasket 44 on the lower half 28 is relatively wide with a substantially flat upper surface, taking up a majority of the width of the lip 36. It has openings 48, round in the illustrated embodiment, that fit over pegs 50 that arise from the lip 36. The openings 48 and pegs 50 fix the gasket 44 in place. On the inner long edges of the lip 36, there are two raised retaining walls 52 that match the peripheral edge 38 that also help to keep the gasket 44 in place. Other means of holding the gasket 44 in place may be used in other embodiments.

On the upper half 26, the arrangement of the gasket 46 is somewhat different. The gasket 46 is narrower than the gasket 44. Along the long sides of the lip 36, the gasket 46 rests within a channel 54 defined by inner and outer raised ridges. Both gaskets 44, 46 traverse the long edges of the lip 36 and dip down (with respect to the orientation of FIG. 2) to make a seal around the edges of the first and second openings 30, 32. While the gaskets 44, 46 of the illustrated embodiment have different cross-sections, they are typically made of the same rubber, and their paths are mirror images of one another, so as to create a good seal.

Interior of the lip 36, each half 26, 28 includes an interior cavity, bordered by the lip 36 and gaskets 44, 46. In approximately the center of that space, a vertical wall 56 is provided. As can be seen in FIG. 2, in the illustrated embodiment, each half 26, 28 carries a portion of that vertical wall 56. In this embodiment, the portion of the vertical wall 56 carried by the lower half 28 is shorter than the portion of the vertical wall 56 carried by the upper half 26, although in other embodiments, the portions of the vertical wall 56 may be of essentially equal height. Alternatively, in some embodiments, the vertical wall 56 may be carried entirely by one half 26, 28 or the other.

The vertical wall 56 is essentially centered in the interior cavity. It has a longitudinal portion 58 that extends parallel to the long axis of the connector 12 and, in the illustrated embodiment, is aligned with the long axis of the connector 12. The vertical wall 56 also has a transverse portion 60 that is attached at its center to the longitudinal portion 58 and extends perpendicular to it, giving the vertical wall 56 a T-shape overall. The transverse portion 60 extends parallel to the first opening 30 and faces the first opening 30 in the illustrated embodiment.

Each half 26, 28 also has gripping structures 62 around the first opening 30. In the illustrated embodiment, these gripping structures 62 comprise several rows of pyramidal teeth, spaced from one another. The arrangement of the teeth 62 is different in the upper and lower halves 26, 28. In the lower half 28, there are three rows of teeth 62, two outside the area sealed by the gasket 44 and one row of teeth 62 inside the area sealed by the gasket 44 but before the vertical barrier 56. In the upper half 26, there are two rows of teeth 62, one row of teeth 62 outside the area sealed by the gasket 46 and one row of teeth 62 inside the area sealed by the gasket 46.

Figure 3:
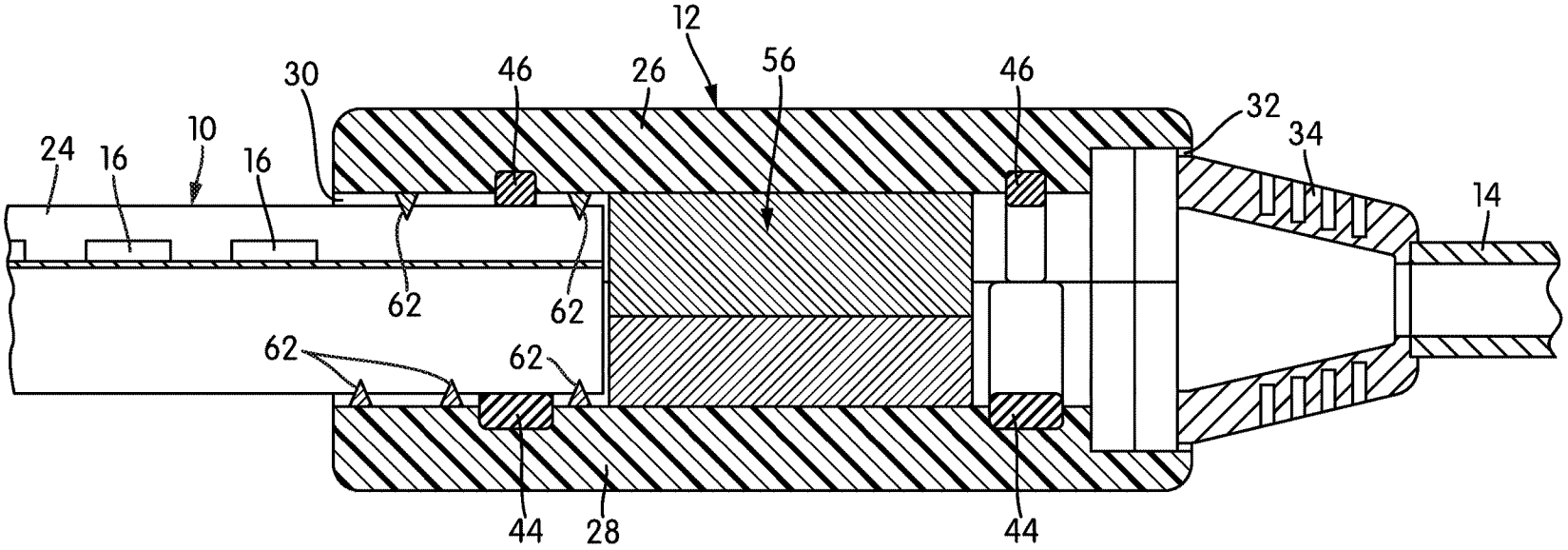
FIG. 3 is a cross-sectional view taken through Line 3-3 of FIG. 1.
Figure 4:
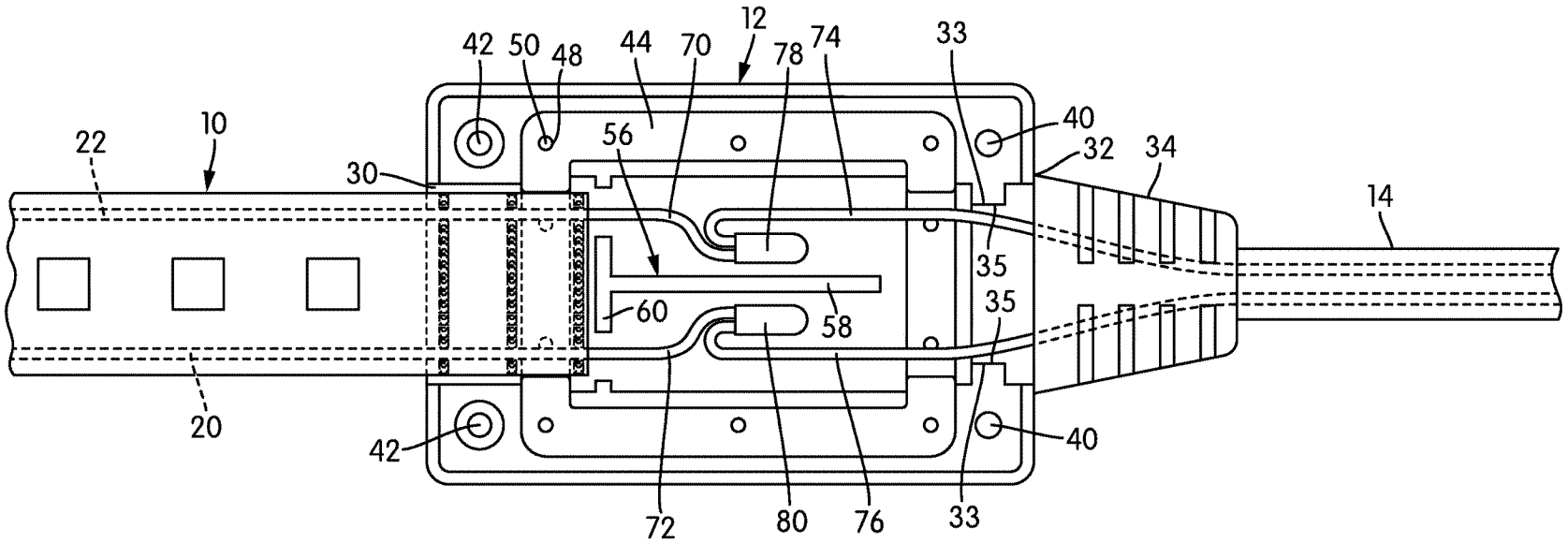
FIG. 4 is a schematic cross-sectional view of the connector of FIG. 1, illustrating the manner of connection between power and ground leads from the LED lighting and power and ground leads from the power cable.

FIG. 3, a cross-sectional view taken through Line 3-3 of FIG. 1, and FIG. 4, a schematic sectional plan view of the connector 12 with the strip light 10 installed, illustrate how the connector 12 engages with the strip light 10. As shown, the vertical wall 56 extends at least substantially the entirety of the height of the interior cavity. In the illustrated embodiment, it extends the entire height of the interior cavity. The strip light 10 is advanced through the first opening 30 until it abuts or nearly abuts the transverse portion 60 of the vertical wall 56. The two gaskets 44, 46 bear against and make a seal against the strip light 10, while the three rows of teeth 62 on the bottom and two rows of teeth 62 on the top increase the friction on the strip light 10 to retain it in position.

In the illustrated embodiment, the positions of the rows of teeth 62 in the upper half 26 do not correspond with the positions of the rows of teeth 62 in the lower half. Rather, they are offset from one another. This distributes the pressure more evenly across the upper and lower surfaces of the strip light 10 and makes it less likely that the strip light will break at any one particular place because of the teeth 62. Of course, this is only one illustration—more or fewer rows of teeth 62 may be used, and those rows of teeth 62 may be arranged in any way. Moreover, while this description uses the term "teeth," any structures that increase friction on the strip light 10 may be used, and those structures may or may not penetrate the outer covering 24 of the strip light 24.

As shown in FIG. 4, the vertical wall 56 divides the interior cavity into separate spaces for power and ground leads. Respective power and ground leads 70, 72 from the strip light 10 meet with counterpart power and ground leads 74, 76 on opposite sides of the vertical wall 56, such that they are separated for at least the length needed to make a connection. A connection may be made by any method that suits the application and complies with regulatory standards. The type of connection may vary depending on the environment in which the connector 12 is to be installed (e.g., wet versus dry), the voltage at which the strip light 10 operates, the regulatory requirements in the area, and preferences of the installer. Examples of connectors that may be used include crimp connectors, twist-on wire connectors, cold weld crimp connectors, and soldered connections. As shown, once completed, the connections or connectors 78, 80 are positioned on opposite sides of the wall 56.

FIG. 4 also illustrates the manner of engagement of the molded strain relief 34 with body of the connector 12. Within the second opening 32, the connector defines inward flanges 33 that mesh with inset grooves 35 in the strain relief 34.

While the leads 74, 76 terminate in a standard modular plug, some embodiments may be hardwired to a power source. As will be described in more detail below, some connectors according to embodiments of the invention may also be adapted for other types of connecting structure.

Figure 5:
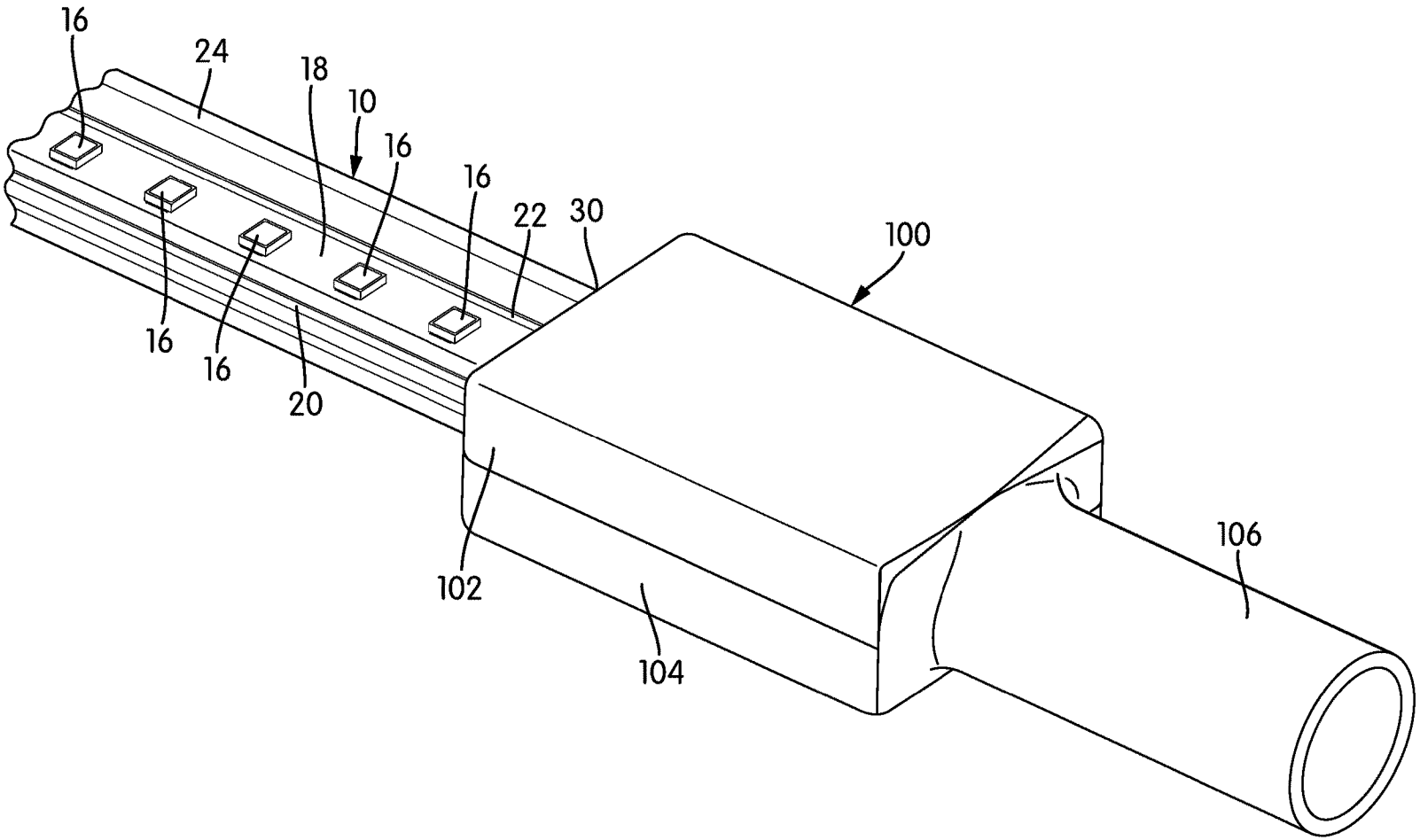
FIG. 5 is a perspective view of a strip of linear LED lighting connected to power via a connector according to another embodiment of the invention.

For example, FIG. 5 is a perspective view of a connector, generally indicated at 100, according to another embodiment of the invention 100. Like the connector 12 described above, the connector 100 receives strip light 10 and connects it to power. Like the connector 12, the connector 100 is also divided into upper and lower halves 102, 104. However, unlike the connector 12, instead of merely providing an opening at the other end, the connector 100 transitions into a short section of pipe, also called a nipple 106.

Particularly where LED strip light 10 is to be installed in wet areas, and in certain other conditions as well, it may be useful to encapsulate the power and ground leads, each of which is insulated, within a secondary container or conduit. In fact, many regulatory schemes require such wires, particularly when carrying high voltages, to be double-insulated or double-jacketed. The nipple 106 allows the connector 100 to connect directly to metal or plastic (e.g., galvanized steel or PVC) conduit, so that power and ground wires leading to the strip light 10 can be appropriately protected from both faults and weather, as will be described below in more detail.

Figure 6:
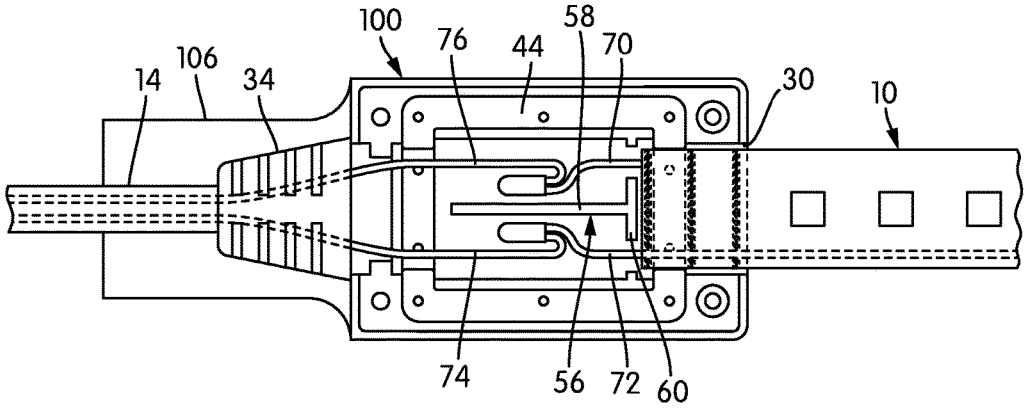
FIG. 6 is a cross-sectional view of the connector of FIG. 5, illustrating the manner of connection between power and ground leads from the LED lighting and external power and ground leads.

FIG. 6 is a schematic cross-sectional view of the connector 100. In this embodiment, the interior layout of the connector 100 is virtually identical to the interior layout of the connector 12 described above. Within an interior cavity sealed by a pair of upper and lower gaskets 44, 46 (only one of which is visible in FIG. 6), a vertical wall 56 with a longitudinal portion 58 and a transverse portion 60 divides the interior cavity, such that power leads 70, 74 and ground leads 72, 76 are separated, and connections 78, 80 between them are also separated and installed on opposite sides of the vertical wall 56.

The primary difference between the connectors 12, 100 lies in how the leads 74, 76 exit the connector 100. Like the connector 12, the connector 100 has a molded strain relief 34 that interlocks with the second opening 32 and carries a cable 14. However, in this case, the strain relief 34 is within and surrounded by the nipple 106 into which the connector 100 transitions. This embodiment may be particularly advantageous when the cable 14 is expected to experience bending or other strains during or after installation.

Figure 7:
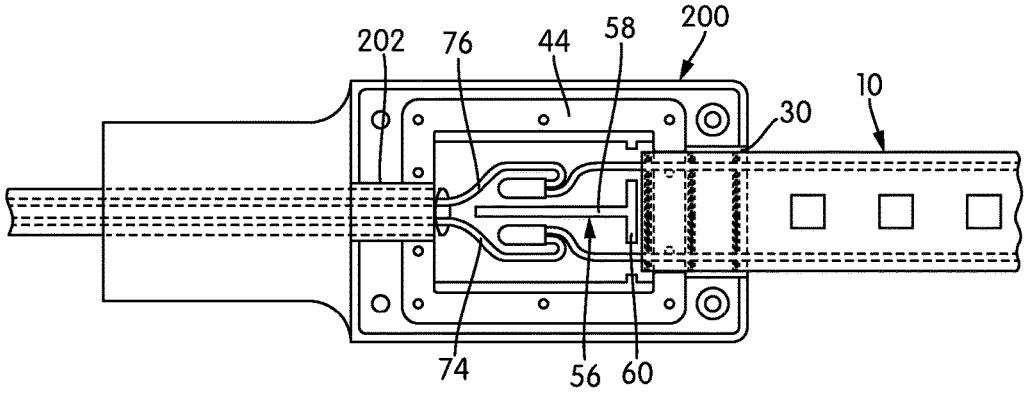
FIG. 7 is a cross-sectional view, similar to the view of FIG. 6, of a connector according to another embodiment of the invention.

There are other possible interior arrangements for the connector. FIG. 7, for example, is a cross-sectional view similar to the view of FIG. 6, illustrating another embodiment of the connector, generally indicated at 200. In the connector 200, the arrangement of the interior cavity is essentially the same as in the connector 100 of FIGS. 1-6. However, in the connector 200, there is no strain relief 34. Instead, jacketed power and ground leads 74, 76 enter through a narrowed second opening 202. The second opening 202 has sufficient dimension to admit the two leads 74, 76, but does not include the flange or structure of the first opening.

Figure 8:
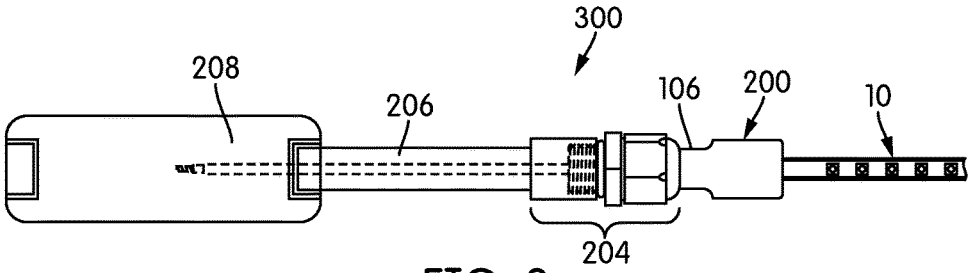
FIG. 8 is an illustration of the connector of FIG. 7 in an assembly, connecting the LED lighting to a junction box.

As an example of how connectors 100, 200 with nipples 106 may be used, FIG. 8 is an illustration of an assembly, generally indicated at 300. A connector 200 (or a connector 100) is attached by its nipple 106 to a set of adapters 204, which, in FIG. 8, comprise a compression fitting. The adapters 204 connect to a conduit 206, which may be of arbitrary length, and may be in multiple sections with elbows and other fittings, as is typical of any installation with conduit. Ultimately, the conduit 206 leads, in this example, to a junction box 208 where electrical connections would typically be made.

If the conduit 206 is PVC pipe, connections may be made with compression fittings, glue, or any other standard mode of connection. Moreover, in the description above, the nipple 106 is a male fitting. Embodiments of the invention may be made with female fittings, and will be described below in more detail.

As those of skill in the art will appreciate, although the basic interior arrangement of the connectors 100, 200 meant to be used with conduit 206 is generally the same as that of the connectors 12 that terminate in a power cord and plug, some adaptations may be made to accommodate the nipple 106 and other connecting structures.

Figure 9:
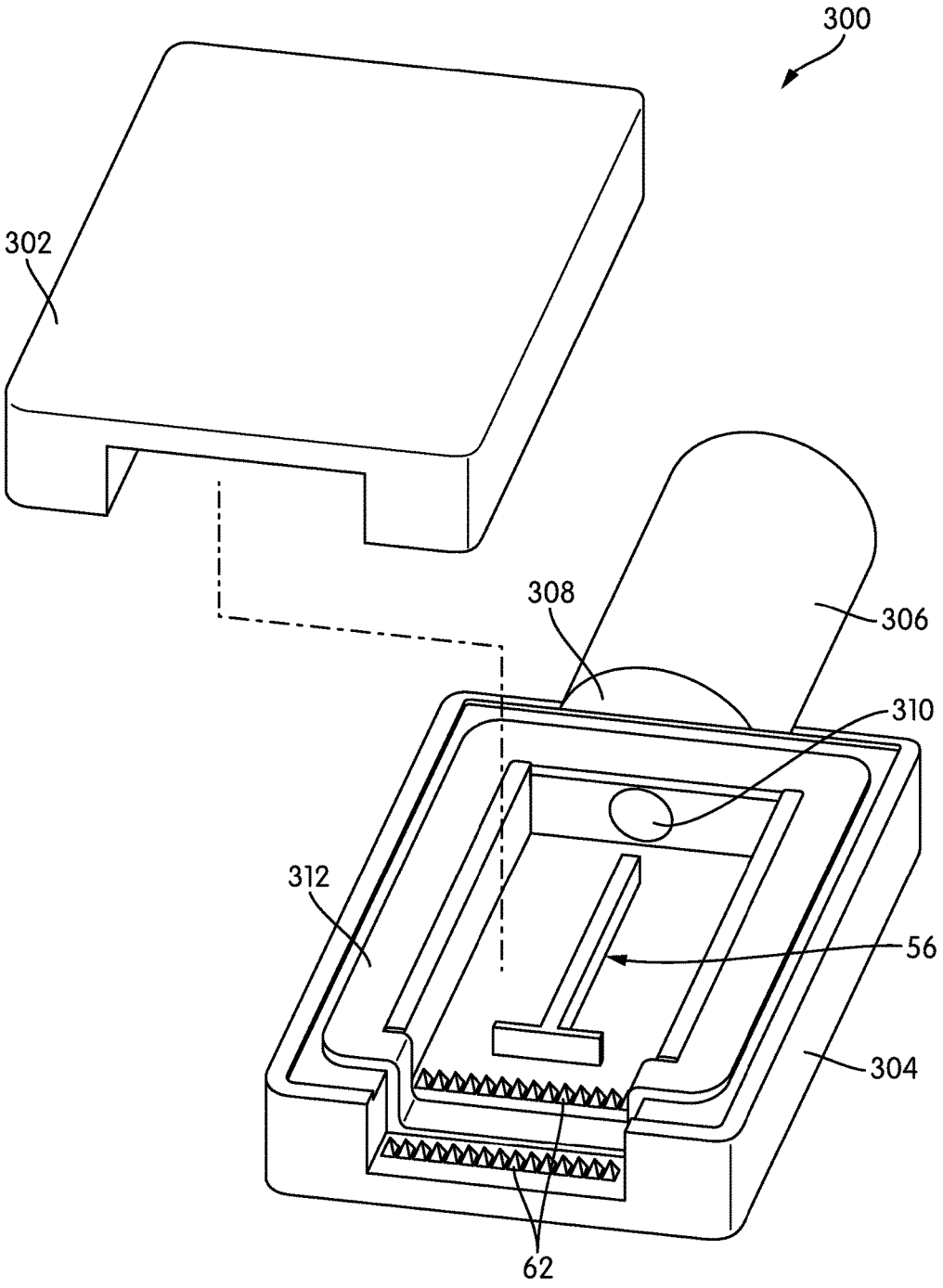
FIG. 9 is an exploded perspective view of a connector according to another embodiment of the invention.

FIG. 9 is an exploded perspective view of a connector 300, which is very similar to the connector 200 described above. The connector 300 has an upper portion 302 that is adapted to be secured to the lower portion 304 in any of the ways described above. In this embodiment, the nipple 106 is connected entirely to the lower portion 304 of the connector 300, although the upper portion 302 may contour somewhat to accommodate it.

As can be seen in FIG. 9, although the nipple 306 of this embodiment provides a standard exterior diameter to connect with pipe fittings, its interior is not completely open. Rather, the face 308 that leads into the connector 300 is closed off, leaving only a small opening 310 that opens into the interior of the connector 300, and through which the power and ground leads can pass. The connector 300 carries the vertical wall 56, teeth 62, and other features described above. The advantage of this configuration is that the gaskets, including the gasket 312, remain relatively flat in shape and arrangement, and their path is relatively uncomplicated.

Figure 10:
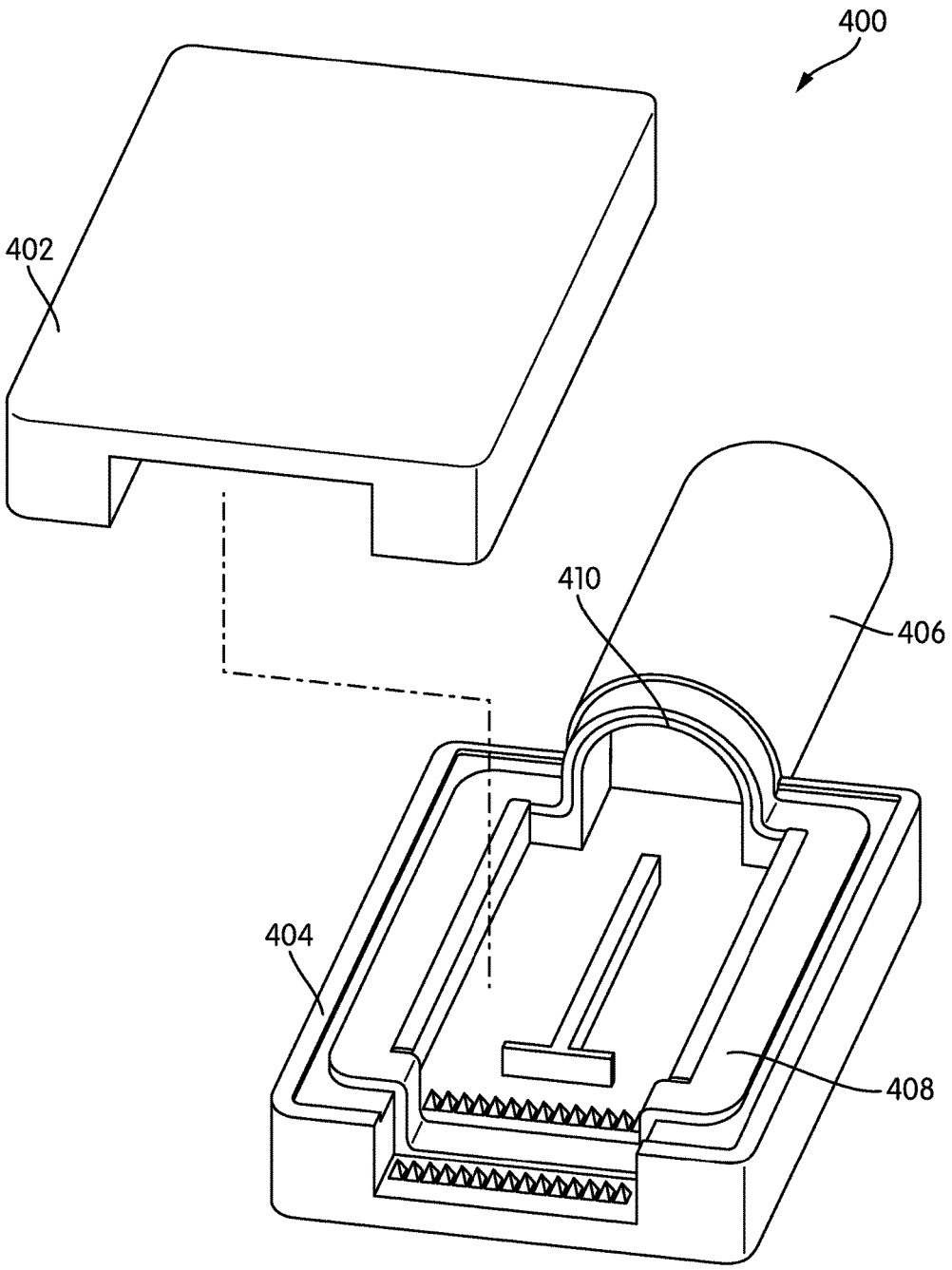
FIG. 10 is an exploded perspective view of a connector according to yet another embodiment of the invention.

By contrast, FIG. 10 is a similar exploded perspective view of a connector 400 according to yet another embodiment of the invention. The connector 400 also includes upper and lower portions 402, 404. The nipple 406 is carried by the lower portion 404 and is fully open where it meets the lower portion 404. In this embodiment, the gasket 408 that seals the lower portion 404 traverses up, over the rounded edge 410 of the nipple 406. While not visible in FIG. 10, the upper portion 402 would have corresponding structure.

Figure 11:
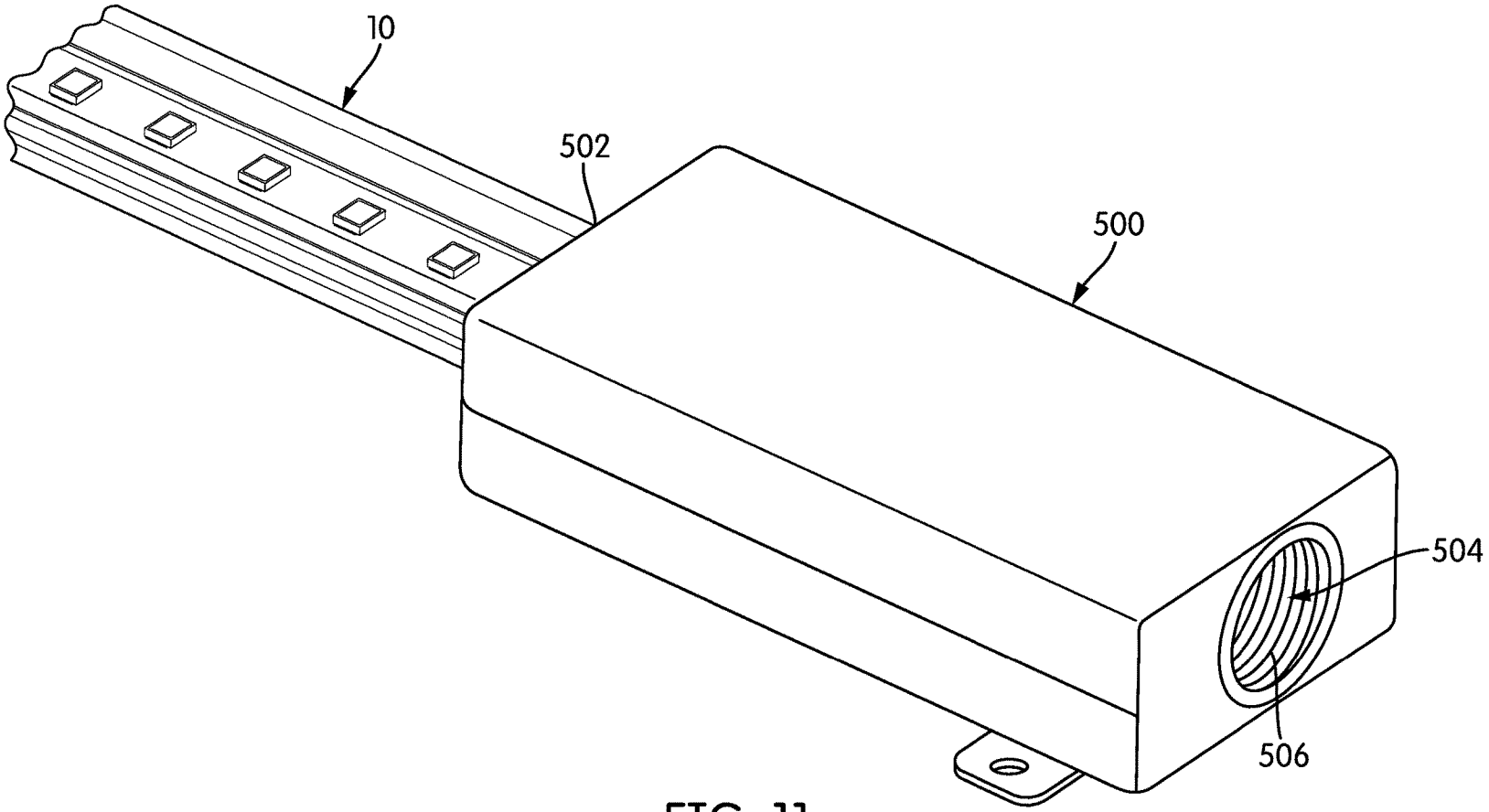
FIG. 11 is a perspective view of a connector with female connecting structure according to a further embodiment of the invention.

The connectors 12, 100, 200, 300, 400 described above all have male hardware, i.e., a nipple 106, to connect to other fittings. As was noted briefly above, that need not be the case in all embodiments. FIG. 11 is a perspective view of a connector 500. As with the other connectors, the connector 500 carries common internal structure, including a vertical wall 56 (not shown in FIG. 11), and has a first opening 502, which a strip light 10 enters. However, instead of a nipple 106, the connector 500 includes an opening 504 into which a conduit or pipe may be inserted. In the illustrated embodiment, the opening 504 has threads 506, although in other embodiments, the connection may be a screw-in connection, a glue-in connection, a press-fit connection, or any other type of connection. It should also be understood that the nipple 106 may have exterior or interior threads, if desired, in order to facilitate connections.

Furthermore, while the connector 500 of FIG. 11 has a generally rectangular overall shape, in other embodiments, it may taper somewhat in width from the end with the first opening 502 toward the end with the second opening 504. This would give the connector, for example, the shape of a trapezoidal prism. While the overall exterior shape of any of the connectors 12, 100, 200, 300, 400, 500 is not critical to their function, it is generally desirable to make the connectors 12, 100, 200, 300, 400, 500 as small as possible considering their function, and to make them with as little material as possible.

Generally speaking, while each of the connectors 12, 100, 200, 300, 400, 500 is shown as being larger than the strip light 10 in the drawing figures, the proportions of the connectors 12, 100, 200, 300, 400, 500 may vary from embodiment to embodiment. Ideally, the cross-sectional size of the connector 12, 100, 200, 300, 400, 500 is as close as possible to the size of the strip light 10, so that the connector can be easily installed in line with the strip light 10.

One advantage of the connectors 100, 200, 300, 400, 500 is that while the connectors themselves are specially adapted for strip light 10, they can be connected to and used with conduit and other fittings that are readily available in a typical hardware store. This would allow a user to make as long a conduit as needed or to deal with unusual connections.

While the invention has been described with respect to various embodiments, the description is intended to be exemplary, rather than limiting. Modifications and changes may be made within the scope of the invention, which is defined by the appended claims.

What is claimed is:

1. A connector comprising:

a housing, defining a first opening sized and adapted to accept an end of a strip light, a second opening, an interior cavity into which the first opening and the second opening open, a vertical barrier spanning essentially an entire height of the interior cavity and dividing the interior cavity into power and ground lead areas, the vertical barrier including a longitudinal portion that extends generally parallel to a long axis of the interior cavity and a transverse portion that is contiguous with, and extends transversely with respect to, the longitudinal portion, the vertical barrier being spaced and separate from sidewalls of the interior cavity and arranged such that the transverse portion faces the first opening and extends parallel to the first opening;

gripping structures projecting from interior top and bottom surfaces of the housing proximate to the first opening; and male or female connecting structure contiguous with the exterior of the housing around the second opening, the connecting structure adapted to make a connection between the connector and external conduit.

2. The connector of claim 1, wherein the second opening is opposite the first opening.

3. The connector of claim 1, wherein the connecting structure comprises a nipple.

4. The connector of claim 1, wherein the connecting structure comprises a socket adapted to accept a pipe.

5. The connector of claim 1, wherein the connecting structure is threaded.

6. The connector of claim 1, wherein the housing is divided into upper and lower portions.

7. The connector of claim 6, wherein a portion of the vertical barrier is carried by each of the upper and lower portions of the housing.

8. The connector of claim 6, wherein the interior cavity further comprises gasket structure surrounding at least the area of the vertical barrier.

9. The connector of claim 8, wherein the gasket structure comprises a first gasket carried by the upper portion of the housing and a second gasket carried by the lower portion of the housing.

10. The connector of claim 9, wherein the first gasket and the second gasket provide seals around the first opening and the second opening.

11. The connector of claim 1, further comprising a flexible strain relief portion engaged with the second opening and extending within the connecting structure.

12. The connector of claim 1, wherein the first opening is rectangular.

13. The connector of claim 1, wherein the gripping structures comprise rows of teeth.

14. A connector comprising:

a housing divided into upper and lower portions, defining a first opening sized and adapted to accept an end of a strip light, a second opening, an interior cavity into which the first opening and the second opening open, a vertical barrier spanning essentially an entire height of the interior cavity and dividing the interior cavity into power and ground lead areas, the vertical barrier including a longitudinal portion that extends generally parallel to a long axis of the interior cavity and a transverse portion that is contiguous with, and extends transversely with respect to, the longitudinal portion, the vertical barrier being spaced and separate from sidewalls of the interior cavity and arranged such that the transverse portion faces the first opening and extends parallel to the first opening, and first and second gaskets seated within the housing that seal an area around the vertical barrier, including at least a portion of the perimeter of the first opening;

gripping structures projecting from interior top and bottom surfaces of the housing proximate to the first opening; and male or female connecting structure contiguous with the exterior of the housing around the second opening, the connecting structure adapted to make a connection between the connector and external conduit.

15. The connector of claim 14, wherein the first gasket and the second gasket provide seals around the first opening and the second opening.

16. The connector of claim 15, wherein the first gasket is carried by the upper portion of the housing, the second gasket is carried by the lower portion of the housing, and the two gaskets abut one another to make a seal.

17. The connector of claim 14, wherein the connecting structure comprises a nipple.

18. The connector of claim 16, wherein the connecting structure comprises a socket adapted to accept a pipe.

19. An electrical connection assembly for an LED strip light, comprising:

a connector having a housing, including a first opening sized and adapted to accept an end of a strip light, a second opening, an interior cavity into which the first opening and the second opening open, a vertical barrier spanning essentially an entire height of the interior cavity and dividing the interior cavity into power and ground lead areas, the vertical barrier including a longitudinal portion that extends generally parallel to a long axis of the interior cavity and a transverse portion that is contiguous with, and extends transversely with respect to, the longitudinal portion, the vertical barrier being spaced and separate from sidewalls of the interior cavity and arranged such that the transverse portion faces the first opening and extends parallel to the first opening, gripping structures projecting from interior top and bottom surfaces of the housing proximate to the first opening, and male or female connecting structure contiguous with the exterior of the housing around the second opening;

a conduit connected at a first end thereof to the housing by the connecting structure; and a junction box connected to a second end of the conduit;

wherein the connecting structure, conduit, and junction box provide a continuous path for electrical leads that connect the LED strip light to power.

20. The electrical connection assembly of claim 19, wherein the connector further comprises gasket structure that makes a seal in an area around the vertical barrier and at least a portion of the perimeter of the first opening.

* * * * *